US005989393A

United States Patent [19]

Kivimaa et al.

[11] Patent Number: 5,989,393

[45] Date of Patent: Nov. 23, 1999

[54] METHOD AND DEVICE FOR GUIDING A LEADER OF A WEB IN A PAPER MACHINE

[75] Inventors: Juha Kivimaa, Jyväskylä ; Martti Hirsimäki, Jyskä, both of Finland

[73] Assignee: Valmet Corporation, Helsinki, Finland

[21] Appl. No.: 08/027,060

[22] Filed: Mar. 5, 1993

[30] Foreign Application Priority Data

Mar. 5, 1992 [FI] Finland ..... 920982

[51] Int. Cl.[6] ..... D21F 3/02; D21F 7/00

[52] U.S. Cl. ..... 162/360.2; 162/193; 162/360.3

[58] Field of Search ..... 162/193, 194, 162/286, 360.2, 360.3, 359.1, 358.1

[56] References Cited

U.S. PATENT DOCUMENTS

| | | | |
|---|---|---|---|
| 2,714,342 | 8/1955 | Beachler | 162/370 |
| 4,526,655 | 7/1985 | Karvinen et al. | 162/360.2 |
| 4,543,160 | 9/1985 | Kerttula et al. | 162/193 |
| 4,561,939 | 12/1985 | Justus | 162/360.2 |
| 4,608,125 | 8/1986 | Autio | 162/360.2 |
| 4,648,942 | 3/1987 | Wanke et al. | 162/193 |
| 4,692,215 | 9/1987 | Kerttula | 162/289 |
| 4,704,192 | 11/1987 | Cronin | 162/360.2 |
| 4,768,294 | 9/1988 | Weideburg | 34/116 |
| 4,874,470 | 10/1989 | Skaugen | 162/193 |
| 4,893,741 | 1/1990 | Heinzmann | 226/196 |
| 4,923,567 | 5/1990 | Liedes et al. | 162/289 |
| 4,970,805 | 11/1990 | Wedel | 34/115 |
| 5,120,400 | 6/1992 | Laapotti | 162/360.3 |
| 5,232,555 | 8/1993 | Daunais et al. | 162/193 |
| 5,240,563 | 8/1993 | Karvinen et al. | 162/360.3 |

FOREIGN PATENT DOCUMENTS

| | | |
|---|---|---|
| 0426607 | 5/1991 | European Pat. Off. . |
| 69145 | 8/1985 | Finland . |
| 78528 | 4/1989 | Finland . |
| 904900 | 4/1991 | Finland . |
| 86901 | 7/1992 | Finland . |
| 92/13133 | 8/1992 | WIPO . |

OTHER PUBLICATIONS

McDonald et al "A New Web Transfer System for Closing the Draw Between Last Press and Dryer Section" CPPA Annual Mtg, 1990.

*Primary Examiner*—Karen M. Hastings
*Attorney, Agent, or Firm*—Steinberg & Raskin, P.C.

[57] ABSTRACT

The invention relates to a device and method in a paper machine for guiding a web and in particular in guiding a leader of the web. The device operates in a paper machine in the area between a center roll of the press section and a separate press nip in the press section. The separate press nip is formed between a smooth-faced upper roll and a hollow-faced lower roll. Around this lower roll, a lower felt of the separate press is placed and runs from a suction-transfer roll placed at the proximity of the center roll as a straight run into the separate press nip. At the initial end of the straight run of the felt of the separate press nip, in connection with the guide roll, air-transfer devices are arranged, by whose means a reduced pressure is produced at least across the width of the leader in connection with a closing inlet nip between the felt and the leader and/or in connection with an opening outlet nip defined between the guide roll and the straight run of the felt.

20 Claims, 3 Drawing Sheets

10a
10b
10c
11
12
13
13a
15
16
16a
17
25
26
28
28a
29
30
32
A
W
$N_1$
$N_2$
$N_3$
$N_4$
$W_0$ 30
31a
31b
32
33a
33b
34
35a
35b
36a
36b
T

METHOD AND DEVICE FOR GUIDING A LEADER OF A WEB IN A PAPER MACHINE

BACKGROUND OF THE INVENTION

The invention relates to a device in a paper machine for guiding a web and in particular for guiding a leader of the web. The device is arranged in a paper machine in an area between a center roll, or equivalent, of the press section and a separate press nip in the press section. The separate press nip is preferably formed between a smooth-faced upper roll and a hollow-faced lower roll. A lower felt is arranged to run around the lower roll and from a guide roll, preferably a suction-transfer roll, placed in proximity to the center roll, as a straight run into and through the separate press nip.

The invention also relates to a method for guiding a web and particularly a leader of the web and an arrangement of a press section in which the device for guiding the web and/or leader is employed.

When a paper machine is started, or after a web break has occurred, an end of the web is passed to the dryer section by cutting, a narrow leader or lateral band which typically has a width of about 200 mm, for example by means of a water jet. In prior art devices, the leader is usually guided manually by means of air jets. However, the constantly increasing running speeds of paper machines has resulted in increasing difficulties in the threading of the web. These difficulties are most severe when a separate press is employed inside the press section, immediately after the press section in the initial part of the dryer, and in gaps between the groups of drying cylinders in the drying section.

In prior art devices, press sections are used that comprise a compact combination of press rolls consisting of two or three press nips placed closed to each other. The web has a closed draw between these press nips. After the combination of rolls, a third or fourth separate press nip follows which is formed between a smooth-faced upper roll and a hollow-faced lower roll. A lower felt is passed through this separate nip. The hollow-faced lower press roll is placed inside a loop of the lower felt. The web of full width and the leader are guided from the smooth-faced center roll of the compact combination of rolls as a short free draw usually over a guide roll onto the upper face of the felt in the separate nip.

On the upper roll of the separate press nip, a broke conveyor and a doctor are commonly employed. The doctor is arranged such that the lateral band (leader) that attempts to be wound around the upper roll is shifted to the side in the transverse direction. The broke conveyor is placed above a substantially horizontal run of the felt of the separate press, which run is guided by a suction-transfer roll into the separate nip. On this run of the web, a suction box is employed immediately before the separate nip to ensure that the web and the leader remain on the top face of the felt. Below the broke conveyor, there is usually a wall which is substantially parallel to the run of the felt that runs underneath the wall. This wall and the straight felt run define a gap therebetween which is a difficult problem point in the threading of the web because of the air flows induced in this gap and the dynamic pressure effects of these air flows.

The lateral band does not adhere to the felt of the separate press after it has been separated from the center roll and blown further. Rather, air remains between the lateral band and the felt. Separation of the web from the felt is also promoted by a strong air current that takes place in the gap defined by the felt and the bottom wall of the broke conveyor placed above the felt. This air current attempts to absorb the web towards the bottom wall of the broke conveyor which causes problems in the operation of the paper machine. These problems have become more serious with increasing running speeds of paper machines.

These problems of threading are also increased by the fact that, in the threading of the leader, the suction zone on the suction roll of the lower felt of the separate press cannot be utilized efficiently in order to made the leader adhere to the lower felt. This is because the suction cannot be applied effectively to the area of the leader as the suction zone "leaks" over the major part of its width in which there is no sealing web. A further problem is constituted by the bag formations arising from the slackness of the leader after the separation from the center roll, and by other, corresponding problems.

In prior art devices, attempts have been made to reduce the slackness of the leader after the center roll in the press by means of a difference in the running speed of the felt of the separate press. However, with increasing running speeds of paper machines, a sufficient reserve for an increase in the running speed in this respect is generally not available.

With respect to the prior art most closely related to the present invention, reference is made to Finnish Patent Nos. FI 69,145 and FI 78,528 (equivalent of U.S. Pat. No. 4,923,567) and to Finnish Patent Application No. FI 915342 (filed on Nov. 12, 1991), in which attempts have been made to solve the problems discussed above.

In FI Pat. Appl. No. 915342, a device in a paper machine similar to that defined above is described for the threading of the leader of the web. In this device, a transverse blow pipe or pipes is/are fitted before the separate press nip on the straight run of the felt of the separate press nip. Blowings or air jets are applied from the blow pipe(s) in a direction opposite to the running direction of the felt and of the web. By means of the blowings, induction of air into the gap space between the straight run of the felt and the wall placed above the run is reduced and, at the same time, the staying and keeping of the leader on the face of the felt on the straight run of the felt before the separate press nip is promoted.

OBJECTS AND SUMMARY OF THE INVENTION

It is an object of the present invention is to provide novel solutions for the problems discussed above.

It is another object of the present invention is to provide a new and improved method and device in which the problems that have been discussed in FI Pat. Appl. 915342 and to eliminate the disadvantages occurring in the device of FI 915342.

It is yet another object of the present invention to provide a new and improved method and device for guiding a leader of a web in a paper machine which can operate under a relatively high running speed of the paper machine.

It is still another object of the invention to provide a new and improved device which guides a lateral band of a web to a separate press nip and by whose means the lateral band is caused to adhere to the upper face of a felt of the separate press nip so that any slackness of the lateral band can be eliminated as it arrives from the center roll of the press section. After this stage, a paper guide roll placed at the proximity of the center roll can, if necessary, be shifted to a lower position. The web can also be spread by means of a diagonal cutter to full width.

In view of achieving the objects stated above and others, in the present invention, air-transfer devices have been arranged in connection with a guide roll at an initial end of a straight run of a felt through a separate press nip, or substantially immediately before the initial end. By means of the air-transfer devices, a reduced pressure is produced at least across the width of the leader in connection with a closing inlet nip arranged between the felt and the leader and/or an opening outlet nip arranged between the guide roll and the straight run of the felt.

The device in accordance with the present invention is preferably arranged in a paper machine arrangement which comprises a center roll around which the web or the leader of the web runs, and a guide roll arranged in proximity to the center roll, an open draw being defined between the center roll and the guide roll. A press nip is arranged after the guide roll in the running direction of the web. A press felt runs from the guide roll as a straight run into the press nip and carries the web into the press nip. In accordance with the invention, air-transfer means are arranged at an initial end, or substantially immediately before the initial end, of the straight run in proximity to the guide roll. A closing inlet nip is defined between the press felt and the web or the leader before the web or leader runs over the guide roll and an opening outlet nip is defined between the guide roll and the straight run. Thus, the air-transfer means produce a reduced pressure at least across a width of the web in the closing inlet nip and/or the closing outlet nip.

In the method of the present invention, a press felt runs over a guide roll which is preceded by an open draw of a web or a leader of the web. Air-transfer means are arranged at an initial end, or substantially immediately before the initial end, of a straight run of the felt arranged after the guide roll. A reduced pressure is produced by means of the air-transfer means at least across a width of the web in at least one of a closing inlet nip defined between the press felt and the web or the leader before the web or leader runs over the guide roll and a closing outlet nip defined between the guide roll and the straight run.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
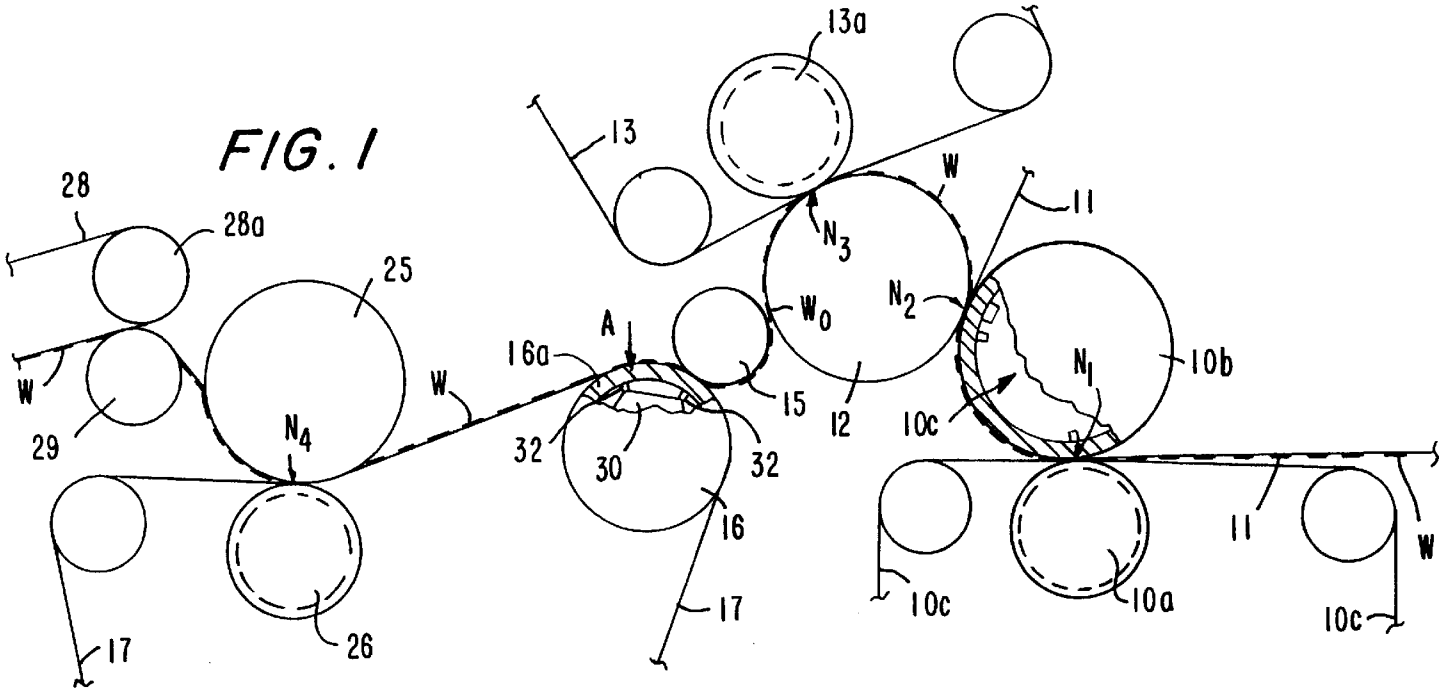
FIG. 1 is a schematic side view of a press section provided with a separate press, in which press section a guide device in accordance with the invention is used in a method in accordance with the invention.

Referring to FIG. 1, a paper web W is brought from a pick-up point P on a lower face of an upper felt 11 into a first press nip $N_1$ which is a two-felt nip. The first press nip $N_1$ is formed between a pair of press rolls 10*a* and 10*b*. After press nip $N_1$, the web W is transferred on the upper felt 11 into a second press nip $N_2$. After the second nip $N_2$, the web W follows the center roll 12 of the press, i.e. runs along an outer surface of the roll. Center roll 12 is provided with a smooth mantle face 12' and forms a third press nip $N_3$ with a press roll 13*a* on which a felt 13 runs. After the third nip $N_3$, the web W continues to follow the smooth face of the center roll 12 until it is separated from roll 12 by means of a paper guide roll 15 as a short free draw $W_o$.

The web W is then transferred onto a lower felt 17 of the separate press with the aid of a suction zone 16*a* of a suction-transfer roll 16. After the suction-transfer roll 16, there is a straight run of the felt 17, which run is slightly inclined downwards. The web W is passed on the run into a separate press nip $N_4$ formed between a smooth-faced upper roll 25 and a hollow-faced lower roll 26. After the separate nip $N_4$, the web is guided by a guide roll 29 and transferred onto a drying wire 28 of the dryer section.

The press section described above is just an example of an environment of an application of the lateral-band guide device in accordance with the invention. It is in no way intended to limit the application of the present invention.

Figure 2:
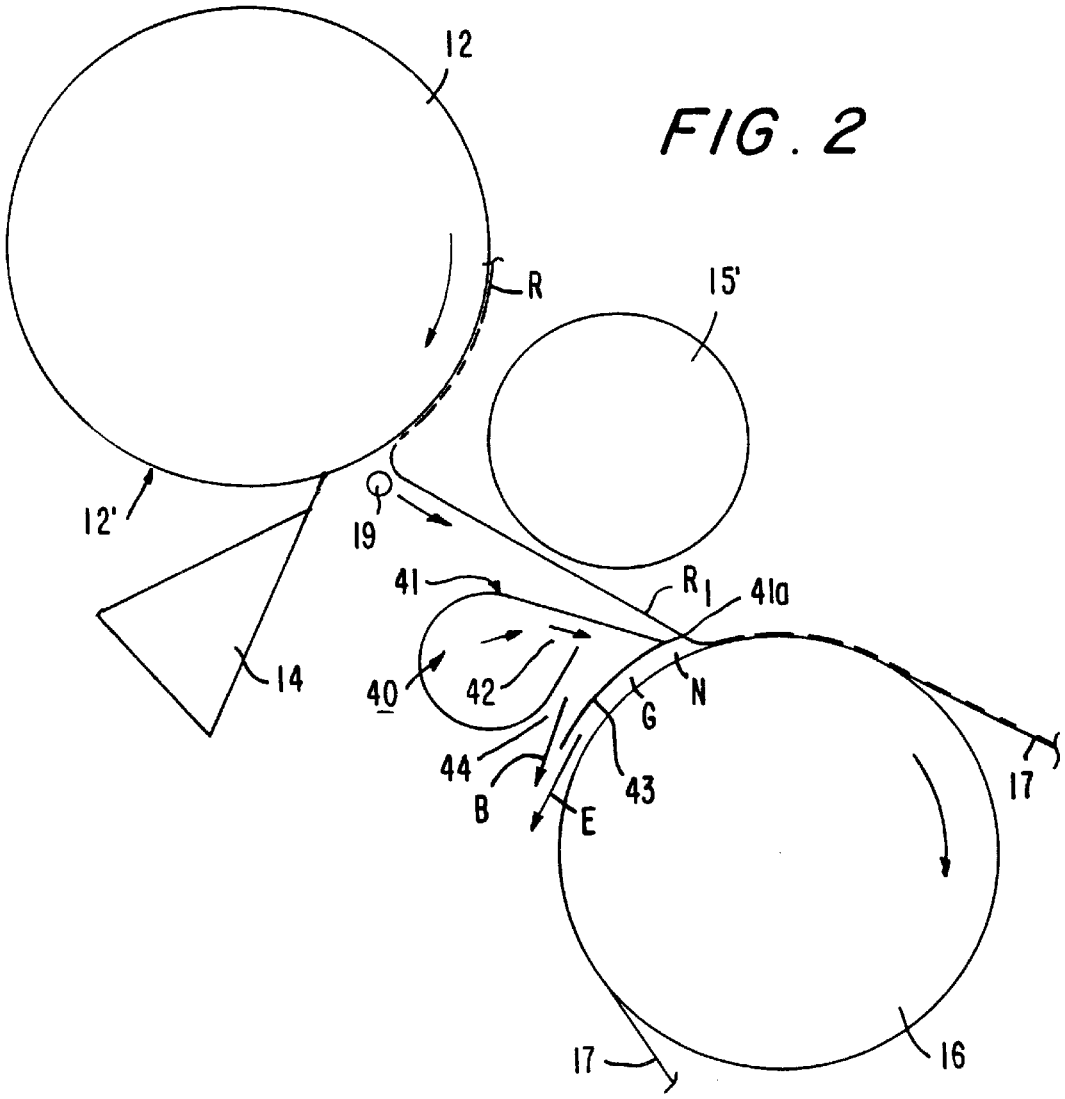
FIG. 2 shows a threading device, in accordance with the invention, placed at the inlet side of the transfer roll which is used in a method in accordance with the invention.

Referring to FIG. 2, a preliminary description will be given of an environment of application of the device in accordance with the invention. A leader R of a width of, e.g., about 200 mm is cut by means of a diagonal cutter (not shown) from one edge of a web W of full width against the face of the center roll 12 in a situation in which the web W is separated from the face of the center roll 12 by means of a blade of a doctor 14 and passed into a pulper (not shown) placed underneath. Detaching blowings are applied to the lateral band R placed on the face 12' of the cylinder 12 from nozzle pipes arranged in a blow device 19 in the manner described in FI Pat. No. 78,528. At this stage, the paper guide roll 15 may have been shifted to an upper position 15'. A guide plate of the guide device 19, and the blowings provided in connection with same, guide and direct the leader R along a path $R_1$ towards the transfer roll 16.

Figure 1A:
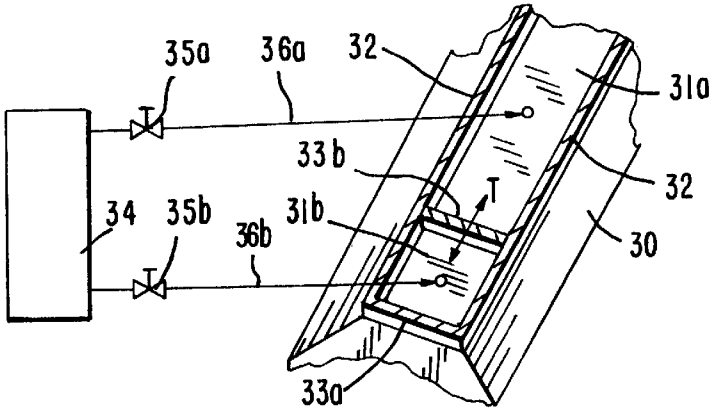
FIG. 1A is an axonometric view, seen in the direction of the arrow indicated in FIG. 1, of a suction box of a suction-transfer roll with different suction zones.

According to FIGS. 1 and 1A, a suction box 30 is arranged in the interior of the suction-transfer roll 16. The suction zone 16*a* of the suction roll 16 extends across the entire width of the web W in the transverse direction. The suction zone 16 is defined by longitudinal sealing ribs 32 and by end seals 33*a* of the suction box 30. Preferably, the suction zone 16*a* is divided into two zones 31*a* and 31*b* in the transverse direction by means of an intermediate sealing rib 33*b*. Zone 31*b* extends over the width of the leader R or slightly beyond this width. A rib 33*b* may be arranged so that its position is adjustable in the direction of arrow T, so that consequently the width of the suction zone 31*b* is also adjustable.

According to the schematic illustration in FIG. 1A, each of the suction zones 31*a* and 31*b* communicates with a suction pump 34 through a pipe duct 36*a*,36*b*. The pipe ducts 36*a* and 36*b* are provided with valves 35*a* and 35*b*, by whose means, when necessary, the suction can be shut off from the wider zone 31*a*. In this case, the entire suction effect of the pump 34 can be concentrated efficiently on the narrow threading zone 31*b* in connection with the threading of the web. By means of the narrow suction zone 31*b*, air can be removed efficiently in the critical area after the guide roll 15 so that the leader R is caused to adhere to the upper face of the felt 17 and be transferred on the felt reliably into the separate nip $N_4$.

When a web W of full width is being run through the press section, the suction prevailing in the suction box 30 may be preferably applied to the entire width of the web W to ensure that the web W adheres efficiently to the upper face of the felt 17 and remains on it up until the separate nip $N_4$.

Referring to FIG. 2, a blow box 40 is arranged after the center roll 12 in the running direction of the web W and underneath the center roll 12 of the press. Blow box 40 is placed directly underneath the guide roll 15. In FIG. 2, the guide roll 15 is shown in the upper position 15' to which it has been shifted for the duration of the threading operation. The blowings applied from the blow pipe 19 separate leader $R_1$ from the smooth face 12' of the center roll 12 and guide it over the blow box 40.

Blow box 40 is provided with an upper guide face 41 which is substantially planar and terminates in an edge fold 41*a*. An extension of the edge fold 41*a* comprises a curved wall 43 of the blow box. The curved wall 43 is placed at the distance of a small gap G from the transfer roll 16 and from the felt 17 that runs over the transfer roll. The outer wall 43 and the wall of the blow box 40 define a nozzle duct 44 therebetween through which air is blown in the direction of arrow B in a direction which is opposite to the direction of movement of the transfer roll 16 and of the felt 17 and substantially tangential in relation to the roll 16. By means of these blowings B, air is ejected in the direction of the arrow E out of the intermediate space G. This arrangement prevents flowing of the boundary layer of air which arrives on the face of the felt 17 into the closing nip N between the felt 17 and the leader $R_1$.

The closing nip N is placed at the level of the front edge 41*a* of the wall 41. In this manner, a slight negative pressure is produced in the nip N to ensure that the leader $R_1$ adheres to the upper face of the felt 17. Together with the blow box 40, it is possible to make use of the transfer-suction roll 16 described above and the suction zones 31*a* and/or 31*b* arranged therein.

Figure 3:
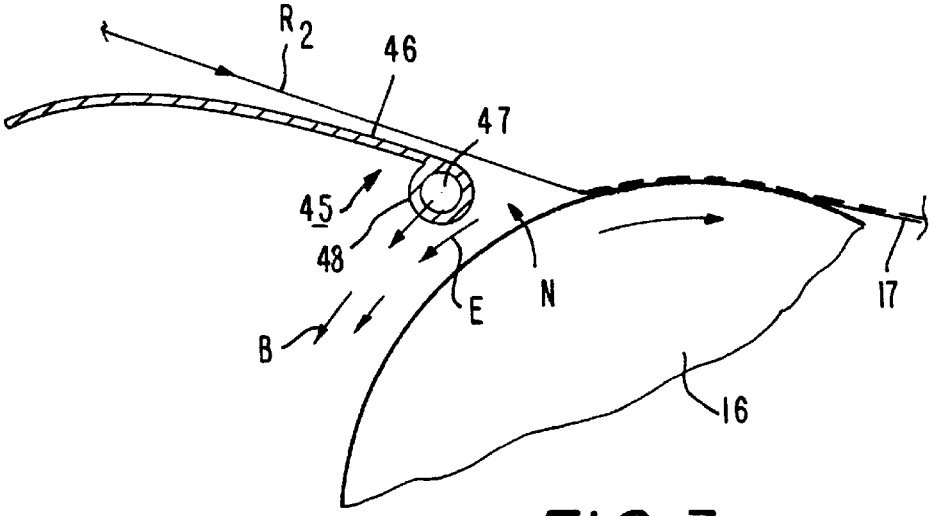
FIG. 3 shows a threading device similar to that shown in FIG. 2 and accomplished by means of a blow pipe.

FIG. 3 shows an embodiment of the present invention in which a blow-pipe device 45 is arranged in the closing nip N between a leader $R_2$ and the transfer roll 16. A guide plate 46 is placed at the front side of the device 45. The device 45 is provided with a blow pipe 47 having a nozzle slot 48, or an equivalent series of nozzle holes, through which strong air blowings B are blown tangentially in relation to a mantle of the transfer roll 16 and in a direction of the felt 17 that runs over the mantle. By means of these blowings, an ejection effect E similar to that described above is produced so that the inlet nip N of the band $R_2$ is subjected to negative pressure.

In the other respects, the construction and the operation of the device illustrated in FIG. 3 are similar to that described above in relation to FIG. 2. The blow box 40 and the blow-pipe device 45 are arranged in the transverse direction either over the width of the leader R only. Alternatively, the devices are extended across the entire width of the web W, in which case the device is provided with a separate edge compartment over the width of the leader R in a constructionally and functionally equivalent way as compared with the end zone 31*b* of the suction box 30 as shown in FIG. 1A.

Figure 4:
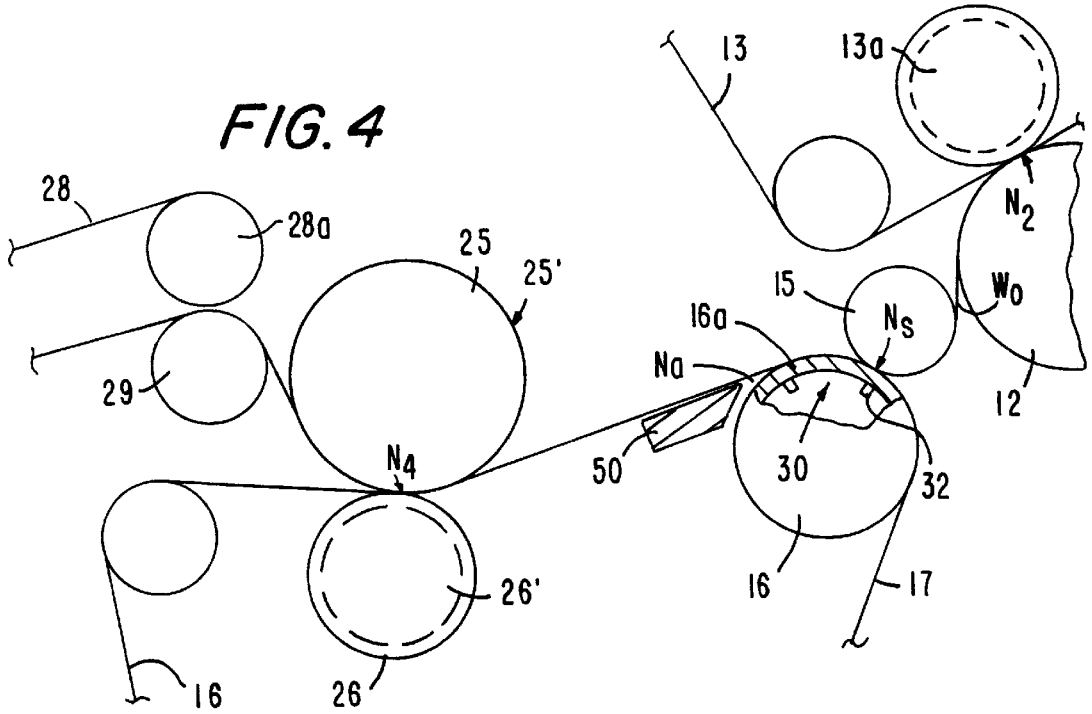
FIG. 4 shows a threading device in accordance with the invention in which a suction-transfer roll and a blow device in accordance with the invention are arranged at the outlet side of the suction-transfer roll.

FIG. 4 shows another embodiment of the present invention and its environment in use in a paper machine. In the position shown in FIG. 4, the web W is of full width and the guide roll 15 is in the lower position in which it forms a transfer nip $N_s$ having a slight load at the initial end of the suction zone 16*a* of the roll 16. The web W is separated from the smooth face of the center roll 12 and passed as a short free draw $W_o$ over the guide roll 15 into the transfer nip $N_s$ in which it adheres to the upper face of the felt 17 by the effect of the negative pressure prevailing in the suction zone 16*a*.

According to FIG. 4, a blow box 50 is placed at the rear side of the roll 16 and produces a reduced pressure, in a manner corresponding to the blow box 40 in FIG. 2, in the opening nip $N_a$ formed between the mantle of roll 16 and the straight run of the felt 17 that is separated from roll 16.

Figure 5:
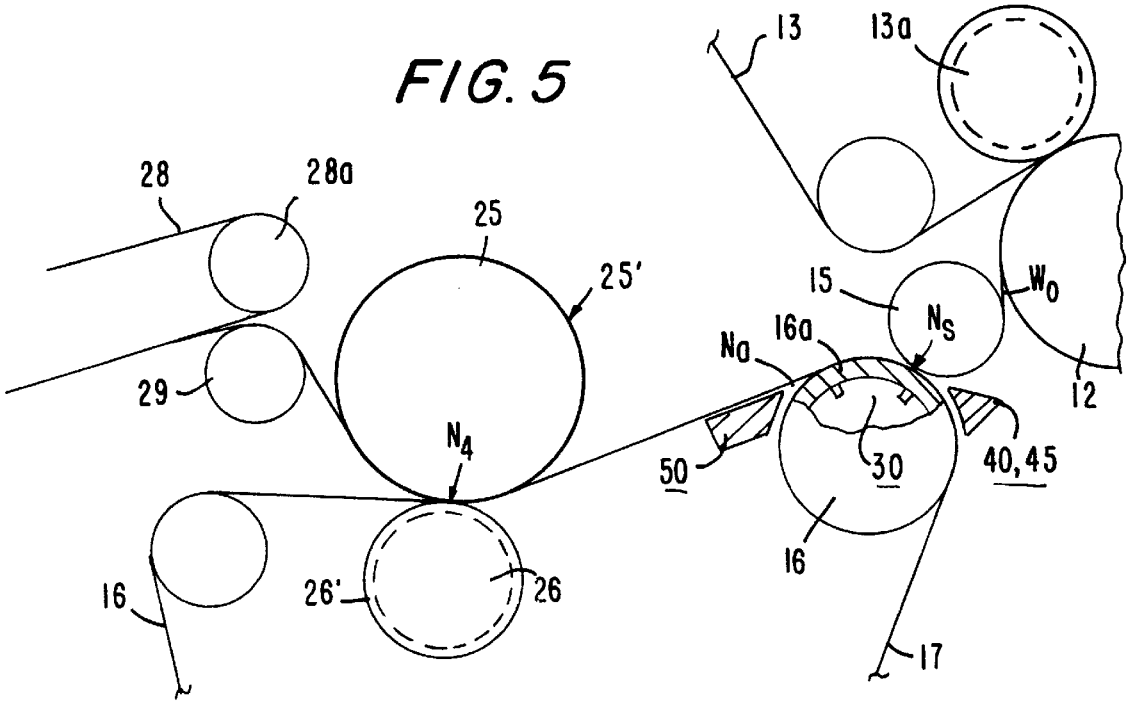
FIG. 5 shows a threading device in accordance with the invention in which blow boxes are employed both at the outlet side and at the inlet side of the suction-transfer roll, together with the environment of the application of the present invention.

Another embodiment of the invention comprises the combination of devices as shown in FIG. 5, which comprises a blow box 40 or a blow-pipe device 45 which is placed at the inlet side of the suction-transfer roll 16 and which is similar to that described in FIG. 2 or equivalent, and a second blow box 50, which is fitted in the opening nip $N_a$ at the rear side of the transfer-suction roll 16 and which is similar to that described above in relation to FIG. 4. The construction as shown in FIG. 5 is preferably used when relatively high web W speeds are used and when particular difficulties occur in the threading of the web and/or in the staying or holding of the web on the face of the felt 17.

The examples provided above are not meant to be exclusive. Many other variations of the present invention would be obvious to those skilled in the art, and are contemplated to be within the scope of the appended claims.

We claim:

1. A device in a paper machine for guiding a leader of a paper web, comprising a first press nip defined by a center roll and a press roll, a transfer roll located after said center roll in a running direction of the web, a second press nip defined between a separate pair of rolls and arranged after said transfer roll in the running direction of the web, a press felt on which the leader of the web is received over said transfer roll and carried through said second press nip, said press felt having a substantially straight run from said transfer roll to said second press nip, the web first touching said press felt as said press felt runs over said transfer roll to thereby define a closing inlet nip prior to contact between the leader of the web and said press felt, and air-transfer means arranged exterior to said transfer roll and at an initial end of said straight run of said press felt in an area between said first press nip and said second press nip, said air-transfer means being positioned proximate to said transfer roll and producing a reduced pressure at least across a width of the leader in an opening outlet nip defined between said transfer roll and said straight run of said felt, said reduced pressure causing the leader to adhere to an upper face of said felt as said felt is detached from said transfer roll and remain adhered to said upper face of said felt as it is carried into said second press nip.

2. The device of claim 1, wherein said transfer roll is a suction-transfer roll comprising a suction box having a suction zone divided into two compartments by means of a partition wall, a first one of said compartments extending substantially over the width of the leader and a second one of said compartments extending substantially over the remainder of the width of the web.

3. The device of claim 2, wherein said suction zone has a suction effect which is substantially concentrated in said first compartment during a threading operation of the paper machine.

4. The device of claim 1, wherein said air-transfer means comprise a blow box arranged in proximity to said closing inlet nip and below a running path of the leader, said blow box comprising a blow nozzle arrangement through which air jets are applied in a direction opposite to the direction of movement of said guide roll and said felt running over said guide roll, said air jets causing air blowings to be drawn out of said closing inlet nip, whereby adhesion to and holding of the leader on an upper face of said felt is promoted.

5. The device of claim 4, wherein said blow box has a substantially planar guide wall over which the leader runs, and curved wall connected to a front edge of said guide wall and placed at a distance from said felt to thereby form a small gap between said felt and said curved wall, said curved wall defining a nozzle opening out of which said air jets are blown.

6. The device of claim 1, wherein said air-transfer means comprise a blow-pipe device arranged in proximity to said closing inlet nip and underneath the running path of the leader, said blow-pipe device comprising a blow-pipe having a nozzle slot or a series of nozzle holes through which blowings are applied in a direction opposite to the running direction of said felt, said blowings causing air to be drawn out of said closing inlet nip.

7. The device of claim 6, further comprising a guide plate attached to said blow pipe, said guide plate extending from said blow pipe towards a mantle of said center roll.

8. The device of claim 1, wherein said air-transfer means comprise a blow device arranged in proximity to said opening outlet nip for lowering the pressure in said opening outlet nip and promoting retention of the leader and/or the web of full width on a top face of said press felt as it runs into said second press nip.

9. The device of claim 1, wherein said straight run is a single wire draw so that an upper face of the web directly contacts one of said press rolls in said second press nip.

10. The device of claim 1, further comprising a guide roll arranged between said first press roll and said transfer roll, the web being transferred from said first press roll to said guide roll as an open draw, said guide roll defining a transfer nip with said transfer roll.

11. The device of claim 10, wherein said transfer roll comprises a suction zone, said transfer nip being formed at an initial end of said suction zone.

12. An arrangement in a paper machine for guiding a leader of a paper web, comprising a first press roll around which the web or the leader of the web runs, a transfer roll arranged in proximity to said first press roll, an open draw being defined between said first press roll and said transfer roll, a press nip arranged after said transfer roll in the running direction of the web, a press felt on which the web or the leader of the web is received over said transfer roll and carried through said nip, said press felt having a straight run from said transfer roll to said press nip, the web first touching said press felt as said press felt runs over said transfer roll to thereby define a closing inlet nip prior to contact between the web and said press felt, air-transfer means arranged exterior to said transfer roll and at an initial end of said straight run in proximity to said transfer roll, and an opening outlet nip defined between said transfer roll and said straight run, said air-transfer means producing a reduced pressure at least across a width of the web in said opening outlet nip, said reduced pressure causing the web or the leader to adhere to an upper face of said press felt as said press felt is detached from said transfer roll and to remain adhered to said upper face of said felt as the web or the leader is carried into said press nip.

13. The arrangement of claim 12, wherein said transfer roll comprises a suction box having a suction zone divided into two compartments by means of a partition wall, a first one of said compartments extending substantially over the width of the leader and a second one of said compartments extending substantially over the remainder of the width of the web.

14. The arrangement of claim 12, wherein said air-transfer means comprise a blow box arranged in proximity to said closing inlet nip and below a running path of the leader, said blow box comprising a blow nozzle arrangement through which air jets are applied in a direction opposite to the direction of movement of said guide roll and said felt running over said guide roll, said air jets causing air blowings to be drawn out of said closing inlet nip, whereby adhesion to and holding of the leader on an upper face of said felt is promoted.

15. The arrangement of claim 14, wherein said blow box has a substantially planar guide wall over which the leader runs, and a curved wall connected to a front edge of said guide wall and placed at a distance from said felt to thereby form a small gap between said guide roll and said curved wall, said curved wall defining a nozzle opening out of which said air jets are blown.

16. The arrangement of claim 12, wherein said air-transfer means comprise a blow-pipe device arranged in proximity to said closing inlet nip and underneath the path of the leader, said blow-pipe device having a nozzle slot or a series of nozzle holes through which air jets are applied in a direction opposite to the running direction of said felt, said air jets causing air to be drawn out of said closing inlet nip, and a guide plate attached to said blow pipe, said guide plate extending from said blow pipe towards a mantle of said center roll.

17. The arrangement of claim 12, wherein said air-transfer means comprise a blow device arranged in proximity to said opening outlet nip for lowering the pressure in said opening outlet nip and promoting retention of the leader and/or the web of full width on a top face of said press felt as it runs into said press nip.

18. The arrangement of claim 12, wherein said second press nip is defined between a smooth-faced upper roll and a hollow-faced lower roll, said felt being arranged to run over said lower roll.

19. The arrangement of claim 18, wherein said straight run is a single wire draw arranged wherein an upper face of the web is carried by said felt into direct contact with said upper roll.

20. The arrangement of claim 9, further comprising a guide roll arranged between said first press roll and said transfer roll, the web being transferred from said first press roll to said guide roll as an open draw, said guide roll defining a transfer nip with said transfer roll.

* * * * *